US005927715A

United States Patent [19]

Novello

[11] Patent Number: 5,927,715

[45] Date of Patent: Jul. 27, 1999

[54] TOY HAVING SELECTIVELY ENGAGEABLE PIECES

[75] Inventor: Silvia Novello, Cuneo, Italy

[73] Assignee: Planet Crea, Inc., New York, N.Y.

[21] Appl. No.: 08/954,242

[22] Filed: Oct. 20, 1997

[51] Int. Cl.[6] ..... A63F 9/10

[52] U.S. Cl. ..... 273/157 R

[58] Field of Search ..... 273/157 R, 153 R, 273/156

[56] References Cited

U.S. PATENT DOCUMENTS

| | | | |
|---|---|---|---|
| 941,680 | 11/1909 | Houghton | 273/157 R |
| 1,084,370 | 1/1914 | Smith | 273/157 R |
| 2,535,619 | 12/1950 | Wright | 273/157 R |
| 3,025,626 | 3/1962 | Schumacher | 273/157 R |
| 3,466,044 | 9/1969 | Somerville | 273/157 R |
| 3,570,144 | 3/1971 | McNutt | 273/157 R |
| 3,856,299 | 12/1974 | Ghovenloo | 273/157 R |
| 5,441,262 | 8/1995 | Figone et al. | 273/157 R |
| 5,520,388 | 5/1996 | Osborne | 273/157 R |
| 5,615,883 | 4/1997 | Stevens | 273/157 R |
| 5,628,513 | 5/1997 | Soriano | 273/157 R |

*Primary Examiner*—Steven Wong
*Attorney, Agent, or Firm*—Charles E. Temko

[57] ABSTRACT

A multiple piece toy in which each piece includes a base having an interconnectable peripheral edge which selectively mates with the peripheral edges of other pieces to enable multiple relationships therebetween. Extending upwardly from each piece is a figurine of animal-like character. Selective interconnection of the pieces forms an infinite variety of groupings of the pieces for play and display.

2 Claims, 2 Drawing Sheets

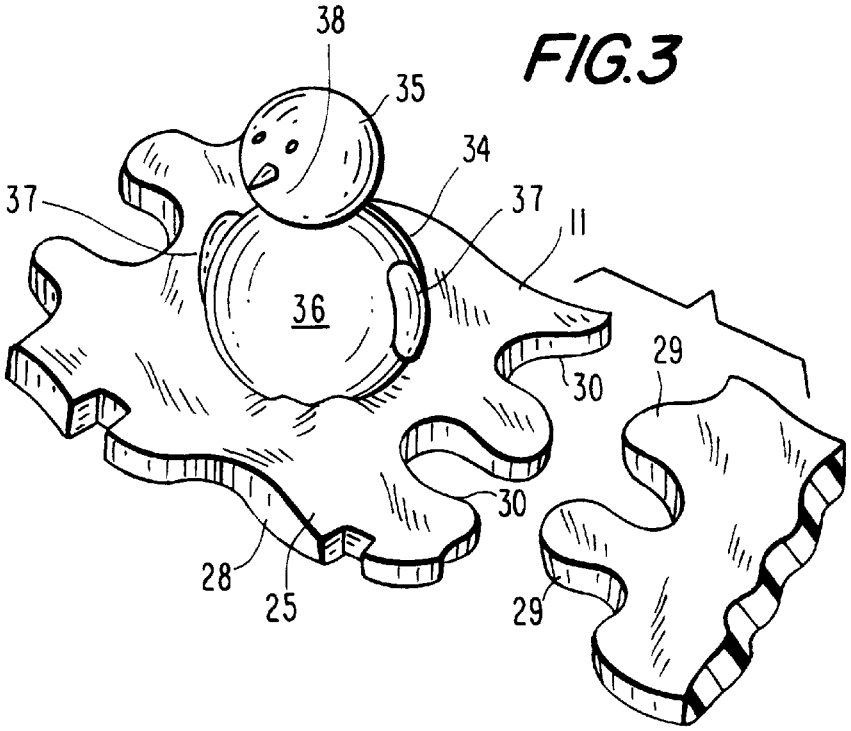
FIG.3
FIG.4
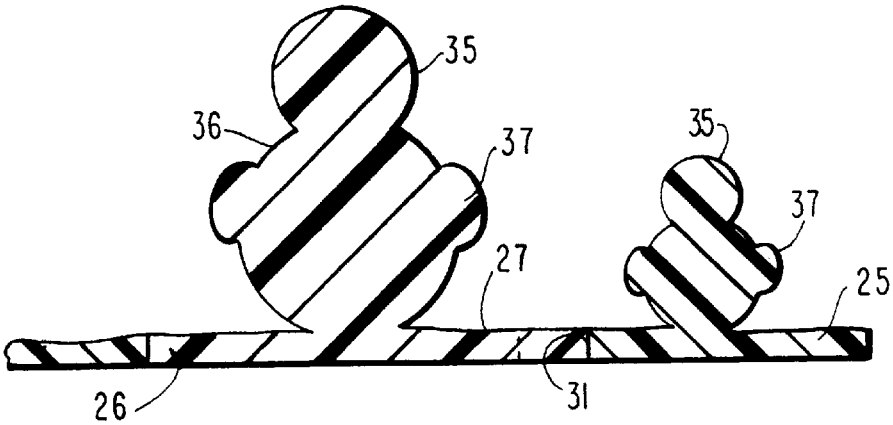
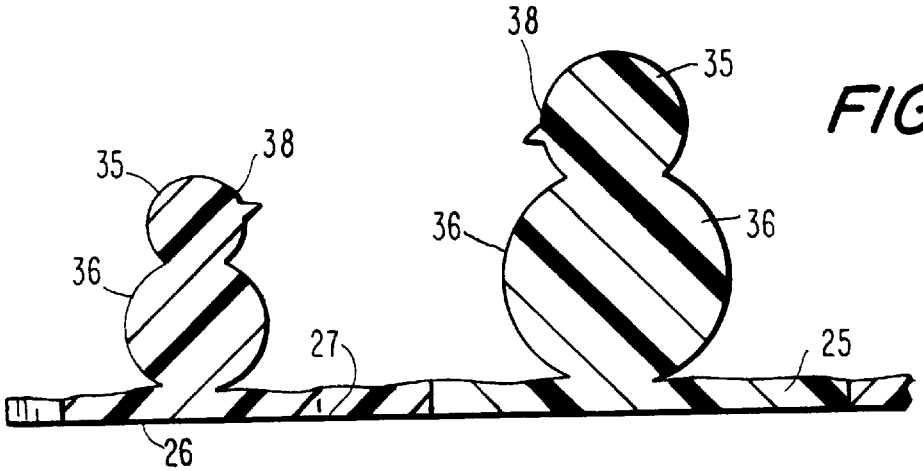
FIG.5

TOY HAVING SELECTIVELY ENGAGEABLE PIECES

BACKGROUND OF THE INVENTION

This invention relates generally to the field of puzzle-type toys, and more particularly to a novel device which extends the play value of puzzle toys of this type.

In the typical jigsaw-type puzzle, there is provided a plurality of generally planar pieces, each having a distinctive peripheral edge shaped to correspond to the peripheral edges of adjacent pieces when the puzzle is completely assembled, in which condition, the combined pieces present on the upper surfaces, a unified display of a particular subject matter. Such puzzles may be constructed with varying complexity for use by children of varying age and intellectual development.

SUMMARY OF THE INVENTION

Briefly stated, the invention contemplates the provision of a toy comprised of plural pieces, each of which includes a planar base having a continuous peripheral edge, the configuration of which permits engagement with other pieces in any of plural possible relationships. Extending from an upper surface of the base is one of plural figurines representing one of a group of related characters. By repositioning the relative arrangement of the bases, the characters are placed in different mutual relation to stimulate the imagination of the user. Typically, although not essential, the characters are all of a single species.

BRIEF DESCRIPTION OF THE DRAWINGS

In the drawings, to which reference will be made in the specification, similar reference characters have been employed to designate corresponding parts throughout the several views.

FIG. 3 is a fragmentary perspective view thereof.

FIG. 4 is a fragmentary sectional view thereof as seen from the plane 4—4 in FIG. 1.

FIG. 5 is a fragmentary sectional view as seen from the plane 5—5 in FIG. 1.

DETAILED DESCRIPTION OF THE DISCLOSED EMBODIMENT

Figure 1:
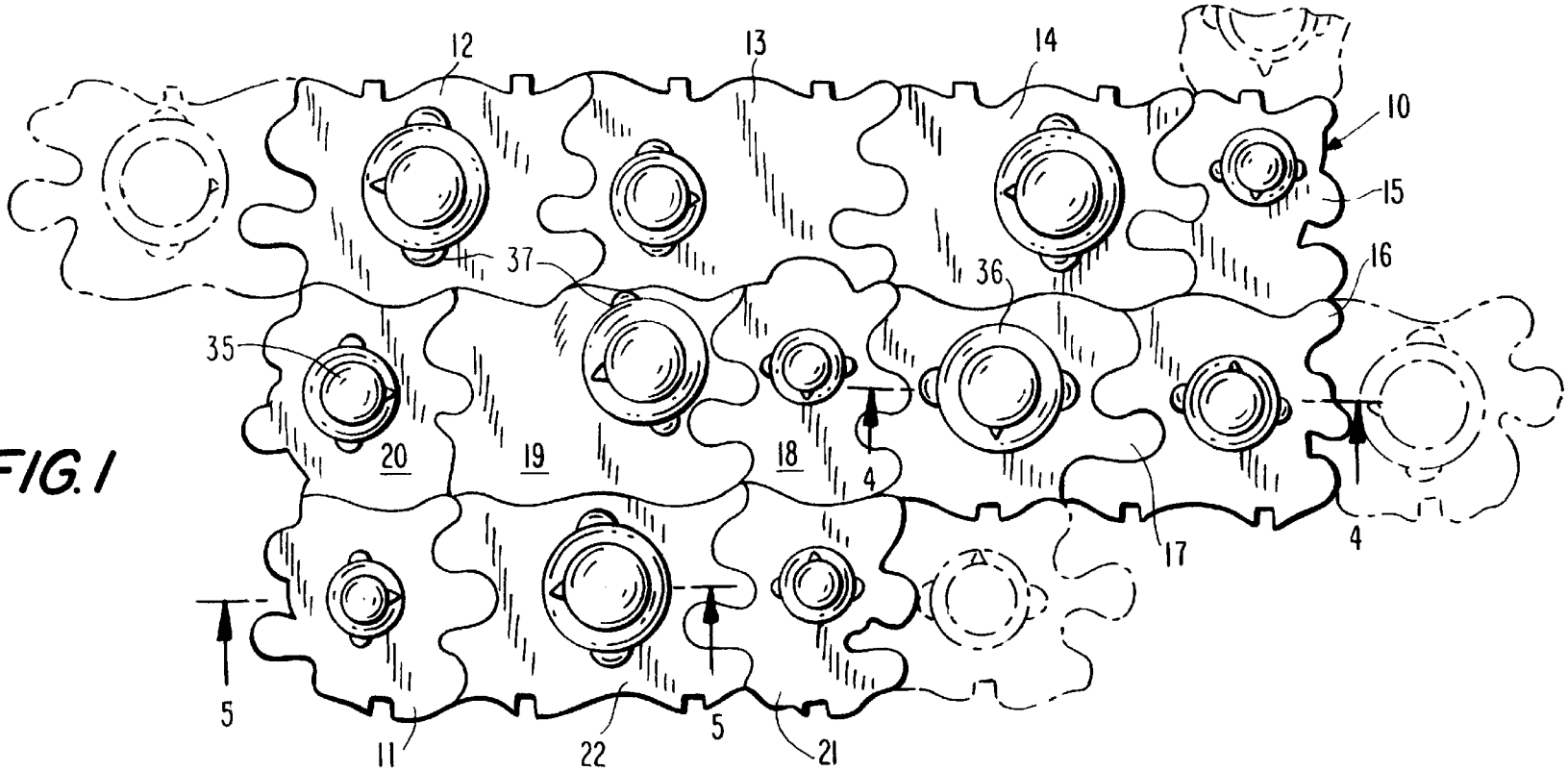
FIG. 1 is a top plan view of an embodiment of the invention.

In accordance with the invention, the device, generally indicated by reference character 10, comprises a plurality of interconnectable pieces of varying size designated by reference characters 11 through 22, inclusive.

Each element 10–22 comprises a base element 25 having a lower surface 26 (FIG. 3), an upper surface 27 (FIG. 2), each piece being bonded by a continuous peripheral edge 28 having interconnectable projections 29 and corresponding recesses 30. At least a portion of the edge 28 corresponds to a portion of the edges of any of at least several of the remaining pieces whereby they may be selectively interconnected in a virtually infinite number of mutually interconnected relationships.

Figure 2:
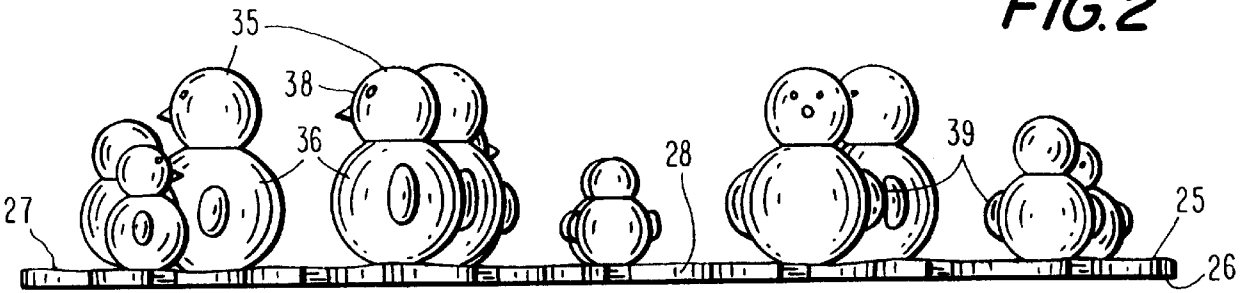
FIG. 2 is a side elevational view thereof.

Extending upwardly from the upper surface 21 of each of the pieces is a representative figurine 34, typically having a head 35, body 36, and arms 37, to depict an animate character, such as those illustrated in FIGS. 2 and 3. In the interconnected relation shown in FIG. 1, certain of the figurines have faces 38 which are oriented toward each other, as might occur during conversation, depending upon the imagination of the user. When rearranged, as contemplated by the invention, the relationship between the figurines will be altered to provide a new arrangement. In the example illustrated, a father and mother are placed in substantially face-to-face relation.

The device is most conveniently formed by injection molding of synthetic resinous materials which have a degree of resiliency upon curing, so as not to be readily damaged, with surface ornamentation applied by suitable screening operations, so that the overall cost of manufacture may be of relatively low order.

It is to be understood that the invention is not considered by be limited to the precise details of construction illustrated in the disclosure, for obvious modifications will occur to those skilled in the art to which the invention pertains.

What is claimed is:

1. A toy comprising a plurality of pieces, each piece having a random continuous curvilinear peripheral edge, individual portions of which have projections and recesses which selectively interconnect with corresponding projections and recesses on corresponding portions of a continuous peripheral edge of at least one other piece to enable any of a plurality of mutual interconnected relationships; each of said pieces having a substantively planar base having upper and lower surfaces and a figurine extending upwardly from said base having a head and face forming a part of said head, whereby a choice of interconnection between a pair of said plurality of pieces results in forming one of a plurality of different specific spacial relationships between adjacent figurines, in which faces on said figurines may selectively be directed toward each other.

2. A toy in accordance with claim 1, in which said pieces are formed as injection moldings from synthetic resinous materials having a degree of resilience after curing.

* * * * *